US012644683B2

(12) United States Patent
Grace

(10) Patent No.: US 12,644,683 B2
(45) Date of Patent: Jun. 2, 2026

(54) ARCHERY ARROW AND RELATED METHOD OF MANUFACTURE

(71) Applicant: Grace Engineering Corp., Memphis, MI (US)

(72) Inventor: Nathaniel E. Grace, Fort Gratiot, MI (US)

(73) Assignee: Grace Engineering Corp., Memphis, MI (US)

( * ) Notice: Subject to any disclaimer, the term of this patent is extended or adjusted under 35 U.S.C. 154(b) by 171 days.

(21) Appl. No.: 18/596,001

(22) Filed: Mar. 5, 2024

(65) Prior Publication Data

US 2025/0283702 A1 Sep. 11, 2025

(51) Int. Cl.
*F42B 6/04* (2006.01)
*F42B 6/08* (2006.01)
*F42B 33/00* (2006.01)

(52) U.S. Cl.
CPC ..... *F42B 6/04* (2013.01); *F42B 6/08* (2013.01); *F42B 33/001* (2013.01)

(58) Field of Classification Search
CPC ..... F42B 6/04; F42B 6/06; F42B 6/08; F42B 33/001
USPC ..... 473/578, 583
See application file for complete search history.

(56) References Cited

U.S. PATENT DOCUMENTS 4,141,554 A * 2/1979 Sherwin ..... F42B 6/06 473/585
4,533,146 A * 8/1985 Schaar ..... F42B 6/04 473/584
4,623,410 A * 11/1986 Hillesheim ..... G01B 5/0023 156/64
4,706,965 A * 11/1987 Schaar ..... F42B 6/04 473/578
4,943,067 A * 7/1990 Saunders ..... F42B 6/04 473/578
5,094,463 A * 3/1992 Dryden ..... F42B 6/04 473/578
5,273,293 A * 12/1993 Lekavich ..... F42B 6/04 473/578
5,465,979 A * 11/1995 Buhler ..... F42B 6/06 473/578
5,516,117 A * 5/1996 Rangel ..... F42B 6/04 473/578
5,547,200 A * 8/1996 Rangel ..... F42B 6/04 403/375

(Continued)

*Primary Examiner* — Alexander R Niconovich

(74) *Attorney, Agent, or Firm* — Warner Norcross + Judd LLP

(57) ABSTRACT

An archery arrow is provided to include a shaft that is tubular and includes an exterior surface and an opposing interior surface, with an insert secured to the shaft. The insert can define a hole configured to join a component, for example, a broadhead with the arrow. The hole can be round and concentric with the exterior surface of the shaft, and in some cases non-concentric with the interior surface. The insert can be adhered to the shaft and later machined to define the hole to provide the concentricity of the hole and the shaft exterior or an associated outer diameter. When a component such as a broadhead is joined with the arrow via installation in the hole, the component can be centered relative to the shaft exterior. A related method of manufacturing an arrow is provided.

19 Claims, 10 Drawing Sheets

(56) References Cited

U.S. PATENT DOCUMENTS 5,611,542 A * 3/1997 Saunders ..... F42B 6/08 473/578
5,644,853 A * 7/1997 Dixon ..... F42B 35/00 33/506
5,921,875 A * 7/1999 Bickel ..... F42B 6/04 403/299
6,520,876 B1 * 2/2003 Eastman ..... F42B 6/04 473/578
6,554,726 B2 * 4/2003 Thurber ..... F42B 6/04 473/578
6,932,728 B2 * 8/2005 Palomaki ..... F42B 6/04 473/578
7,004,859 B2 * 2/2006 Palomaki ..... F42B 6/08 473/578
7,013,772 B1 * 3/2006 Grace, Jr. ..... F41B 5/14 82/1.11
7,077,770 B2 * 7/2006 Palomaki ..... F42B 6/04 473/578
7,651,421 B2 * 1/2010 Smith ..... F42B 6/08 473/582
7,686,714 B2 * 3/2010 Smith ..... F42B 6/04 473/578
7,811,186 B2 * 10/2010 Palomaki ..... F42B 6/08 473/578
8,057,330 B2 * 11/2011 Blosser ..... F42B 6/04 473/582
8,337,342 B1 * 12/2012 Huang ..... F42B 6/04 473/582
8,388,473 B2 * 3/2013 Smith ..... F42B 6/04 473/578
8,403,777 B1 * 3/2013 Huang ..... F42B 6/04 473/582
8,496,548 B2 * 7/2013 Connolly ..... F42B 6/04 473/578
9,297,620 B2 * 3/2016 Boretto ..... F42B 33/001
9,395,166 B1 * 7/2016 Huang ..... F42B 6/04
9,441,927 B1 * 9/2016 Huang ..... F42B 6/08
9,644,927 B2 * 5/2017 Connolly ..... F42B 10/00
9,829,291 B2 * 11/2017 Boretto ..... F42B 6/04
9,915,510 B1 * 3/2018 Huang ..... F42B 6/08
9,982,975 B1 * 5/2018 Huang ..... F42B 6/06
10,852,109 B1 * 12/2020 Schaar ..... B32B 21/08
11,179,899 B2 * 11/2021 Greenwood ..... B29C 33/42
11,402,183 B2 * 8/2022 Ozanne ..... F42B 6/06
12,025,419 B2 * 7/2024 Fisher ..... F42B 6/08
2006/0281593 A1 * 12/2006 Young ..... F42B 6/04 473/578
2012/0270688 A1 * 10/2012 Webber ..... F42B 6/08 473/578
2014/0256481 A1 * 9/2014 Flint ..... F42B 6/04 473/578
2017/0059290 A1 * 3/2017 Greenwood ..... F42B 6/04
2017/0067723 A1 * 3/2017 Pedersen ..... B29C 45/0013
2024/0310152 A1 * 9/2024 Ferguson ..... F42B 6/04

* cited by examiner

ARCHERY ARROW AND RELATED METHOD OF MANUFACTURE

BACKGROUND OF THE INVENTION

The present invention relates to archery, and more particularly to archery arrows, bolts and other projectiles.

Many conventional archery arrows and bolts, which are referred to interchangeably herein, are constructed as elongate, tubular shafts having openings at opposing ends. To complete the arrow, fletchings can be secured to the exterior of the shaft, and an insert and a nock can be installed at the respective opposing ends of the shaft, typically being cemented to the shaft.

Presently, most arrows are constructed from carbon or composite materials that are wrapped in layers with a resin on a mandrel to form the elongate tubular shaft. This shaft includes an exterior having a generally cylindrical shape with some surface imperfections and varying contours. Because the shaft is tubular, it includes an outer diameter (OD) and an inner diameter (ID). The OD may likewise be inconsistent and can vary along the length of the shaft due to the wrapping process and the surface imperfections or varying contours.

The shaft forming the arrow is further processed whereby the exterior of the arrow is centerless ground with a machine to form a consistent, cylindrical outer surface and a new corresponding outer diameter of the shaft. As the name of the grinding process suggests, the OD is ground without relation to the precise center of the shaft, and without relation to the ID of the shaft. This produces a naturally non-concentric condition because the center of the OD is non-concentric with the center of the ID. These centers are thus offset from one another.

With a shaft formed in such a non-concentric OD to ID configuration, the later positioning and securement of an insert or nock likewise can be skewed and imperfect. The result is that the insert or nock is non-concentric to the outer diameter and center ground exterior of the arrow shaft, which is, and has been, the standard for decades of arrow manufacture. Indeed, it is believed that no current composite arrow manufacturer ensures the OD to ID relationship is concentric and in most cases it is believed that conventional manufacturing processes can actually make non-concentricity worse.

Further, the vast majority of inserts, and for that matter nocks, use the ID of the shaft to place the insert or nock relative to the shaft, however, the arrow is used and measured based on the OD of the shaft. For reference, Guideline for the ATA Measurement of Arrow Shaft Static Spine (Stiffness) of a Non-Wood Arrow Shaft, Designation: ATA/ARR-202-2008ATA/ARR-202-2008 and Guideline for the ATA Measurement of Round Arrow Shaft Straightness, Round Arrow Shaft Straightness, Designation: ATA/ARR-203-2008 are the industry standards on measuring Arrow Shaft Straightness. Arrow Shaft Straightness is one of the key features in selling arrows. An arrow that is +/−.001" straight has a higher retail value than the +/−.003" and the +/−.005". These measurements are all based on the OD of the arrow. When a broadhead is joined with an insert that is concentric with the ID but not the OD, due to the nonconcentric ID to OD, the weight distribution and arrow spin is compromised regardless of how "straight" the arrow is because the broadhead is off center and nonconcentric with the OD and exterior of the arrow.

Accordingly, there remains room for improvement in the field of arrows, and in particular the concentricity of arrow shafts and inserts.

SUMMARY OF THE INVENTION

An archery arrow is provided to include a shaft that is tubular and includes an exterior surface and an opposing interior surface, with an insert secured to the shaft.

In one embodiment, the insert can define a hole configured to join another component with the arrow. The hole can be round and concentric with the exterior surface of the shaft. When the component is joined with the arrow via installation in the hole, the broadhead can be centered relative to the shaft exterior.

In another embodiment, the insert can be adhered to the shaft and later machined to define the hole to provide the concentricity of the hole and the shaft exterior and/or an associated outer diameter, while the insert is fixed to the shaft.

In still another embodiment, the shaft can be tubular and can include an exterior surface and an opposing interior surface. The exterior surface can be centered on an outer diameter longitudinal axis and the opposing interior surface can be centered on an inner diameter longitudinal axis. The outer diameter longitudinal axis can be offset a first distance from the inner diameter longitudinal axis.

In yet another embodiment, the insert can be secured to the shaft and can define a round hole configured to join a broadhead with the arrow. The round hole can be concentric with the exterior surface of the shaft, but the round hole can be non-concentric with a portion of the interior surface.

In even another embodiment, the round hole has a hole longitudinal axis which can be common with and lay along the outer diameter longitudinal axis. The hole longitudinal axis also can be offset the first distance from the inner diameter longitudinal axis.

In a further embodiment, the shaft can include the interior surface. The interior surface can include a shoulder defined between a cylindrical bore and an elongated cavity extending within the shaft. The insert can be secured in the cylindrical bore but does not extend past the shoulder to the elongated cavity. The cylindrical bore can include a bore axis that is coextensive with the outer diameter longitudinal axis. The elongated cavity can include a cavity axis that is coextensive with the inner diameter longitudinal axis but offset from the bore axis and the outer diameter longitudinal axis. The elongated cavity can be the portion of the interior surface that is nonconcentric with the round hole.

In still a further embodiment, a method is provided. The method can comprise providing a shaft that is tubular and round and includes an exterior surface and an opposing first interior surface, the exterior surface centered on an outer diameter longitudinal axis, the opposing first interior surface centered on an inner diameter longitudinal axis; and securing an insert to the shaft, the insert including an exterior insert surface that is round. The insert can be centered relative to the exterior surface of the shaft to balance the arrow.

In yet a further embodiment, the method can comprise defining in the insert an insert center and an insert longitudinal axis passing through the insert center, wherein the insert longitudinal axis is offset a first distance from the inner diameter longitudinal axis.

In even a further embodiment, the method can comprise installing the insert in the shaft adjacent the first interior surface, the insert including a face extending outside the shaft; adhering the insert to the shaft with an adhesive during said securing; and forming a hole in the insert after said adhesive cures.

In another embodiment, the method can comprise providing a hole longitudinal axis in the hole. The hole longitudinal axis can be common with and lay along the outer diameter longitudinal axis. The hole longitudinal axis can be offset a first distance from the inner diameter longitudinal axis.

In still another embodiment, the method can comprise forming a second interior surface centered on the outer diameter longitudinal axis in the shaft before said securing step. The second interior surface can be concentric with the exterior insert surface, which is concentric with the exterior surface of the shaft. The forming the second interior surface can comprise removing a shaft material from the first interior surface.

In yet another embodiment, the method can include centerless grinding the shaft to produce the exterior surface of the shaft and a corresponding outer diameter, with an outer diameter longitudinal axis. This can be performed before the insert is installed relative to the shaft.

The current embodiments provide an arrow and related method of manufacture that significantly improved finished arrow concentricity, which in turn promotes consistent and well-balanced arrow flight. For example, when a broadhead, tip or point is secured to the arrow, and in particular an insert defining a hole that is concentric with the outer surface of the arrow, the broadhead, tip or point will fly well and consistently because it is concentric with the outer surface of the shaft rather than an inner surface of the shaft. This can enhance accuracy and precision of the arrow.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
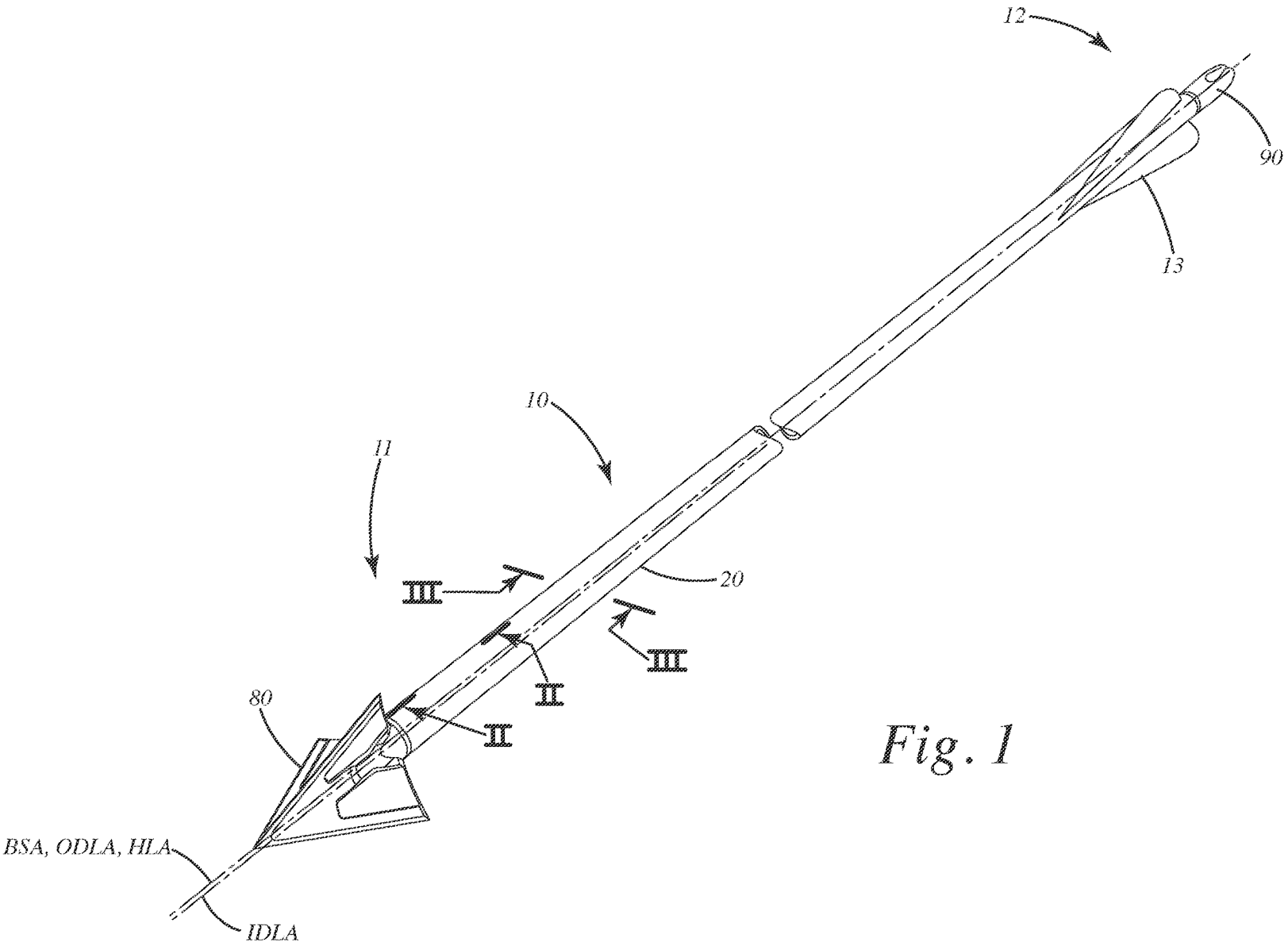
FIG. 1 is a perspective view of an arrow of a current embodiment with a broadhead installed.

A current embodiment of an archery arrow is shown in FIGS. 1-8 and generally designated 10. The arrow 10 is shown as an elongated arrow for use with archery equipment such as compound bows, recurve bows, long bows, crossbows and the like. As used herein, an archery arrow can include any type of arrow, bolt or elongated projectile, all referred to herein as an arrow. The arrow 10 is illustrated with a component 80, optionally in the form of a broadhead, joined with a first end 11 of an arrow shaft 20 and another component 90, optionally in the form of a nock joined with an opposite and distal second end 12 of the shaft 20. The arrow also can include fletchings 13 or other flight stabilizers at the second end.

Figure 8:
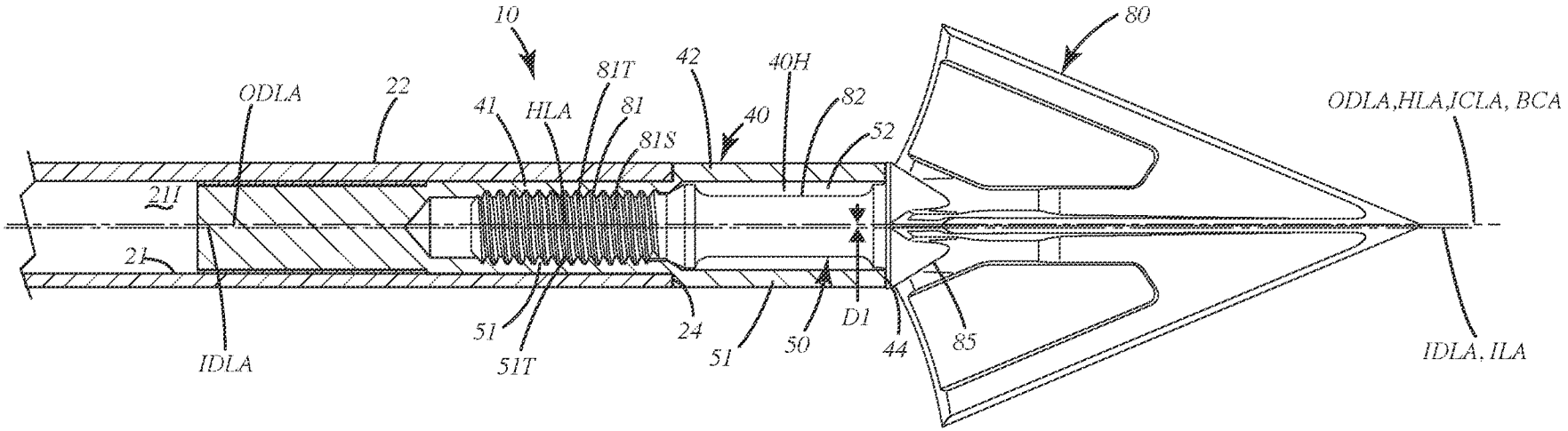
FIG. 8 is a is a sectional view of a broadhead installed in the fully machined insert in the shaft.

The broadhead 80 is shown including a broadhead central axis BCA about which the broadhead can be relatively rotationally balanced and/or symmetric. That axis BCA can be common with, lay along and can be generally the same axis as the outer diameter longitudinal axis ODLA of the shaft 20, and/or the hole longitudinal axis HLA when the broadhead is installed in a hole 40H of an insert 40 as shown in FIG. 8, as described below. As used herein, a broadhead refers to any of the following: a fixed blade broadhead, a pivoting blade broadhead, a rear deploying blade broadhead, a field tip, a fish point, a game head, a judo point, a Bodkin point, a bullet point, a blunt tip, and/or any other type of head, tip, point or other component that can be secured to an end of an arrow.

Figure 7:
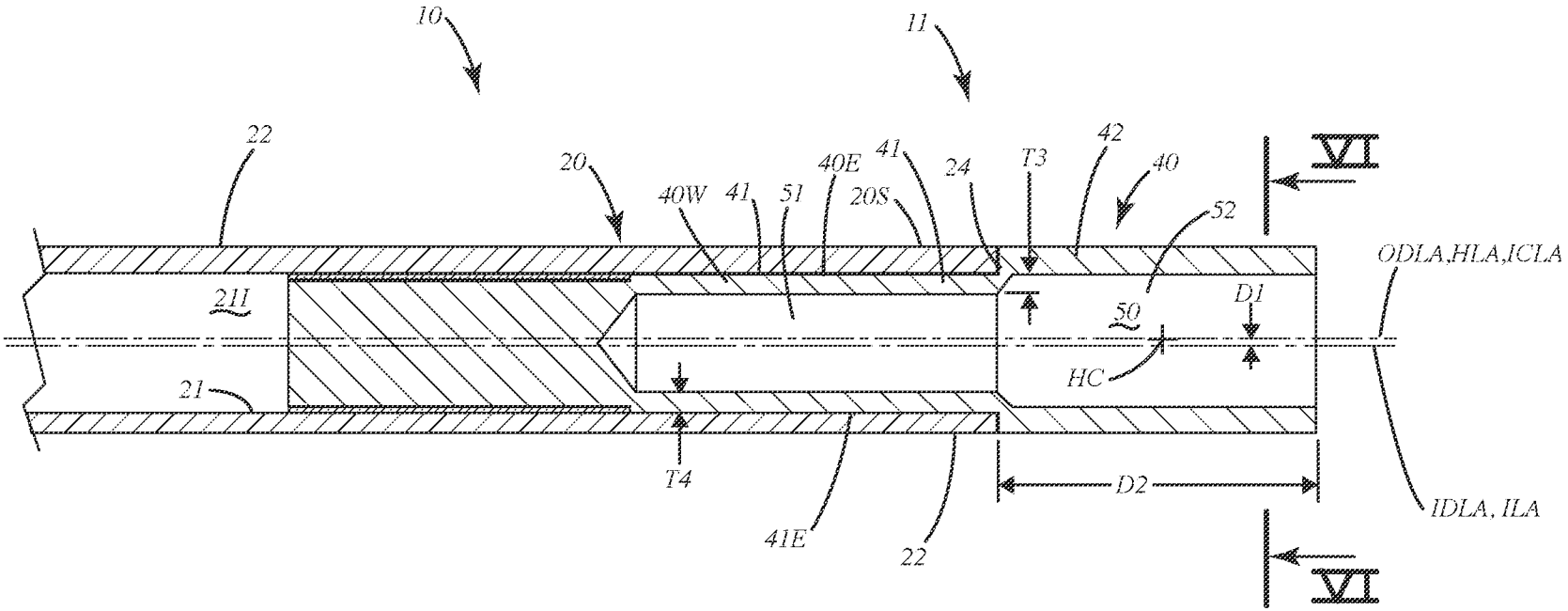
FIG. 7 is a sectional view of the shaft and installed insert.

With reference to FIGS. 7 and 8, the current embodiment of the arrow 10 will be described with the broadhead 80 removed from the arrow 10. There, the arrow 10 is shown with an insert 40 joined with the shaft 20 at a first end 11 of the arrow 10. It will be appreciated that a similar insert can be disposed at the second end 12 to join a component, such as a nock or other device, to the shaft 20. The shaft 20 as illustrated is in the form of an elongated tubular element. This tubular element can be round and/or cylindrical. Of course, the tubular element can come in other cross sections and shapes. When taken perpendicular to the length of the shaft 20, a cross section of the shaft shown in FIG. 8 can be round or circular. The shaft inner or interior surface 21 and its outer or exterior surface 22 also can be round or circular. These interior and exterior surfaces can be generally cylindrical along the length of the shaft. Each of the interior 21 and exterior surfaces can be in the form of elongated cylindrical surfaces, which may include minor surface contours, aberrations, discontinuities, bumps, ridges, undulations, recesses and/or grooves, yet still be considered cylindrical.

Figure 2:
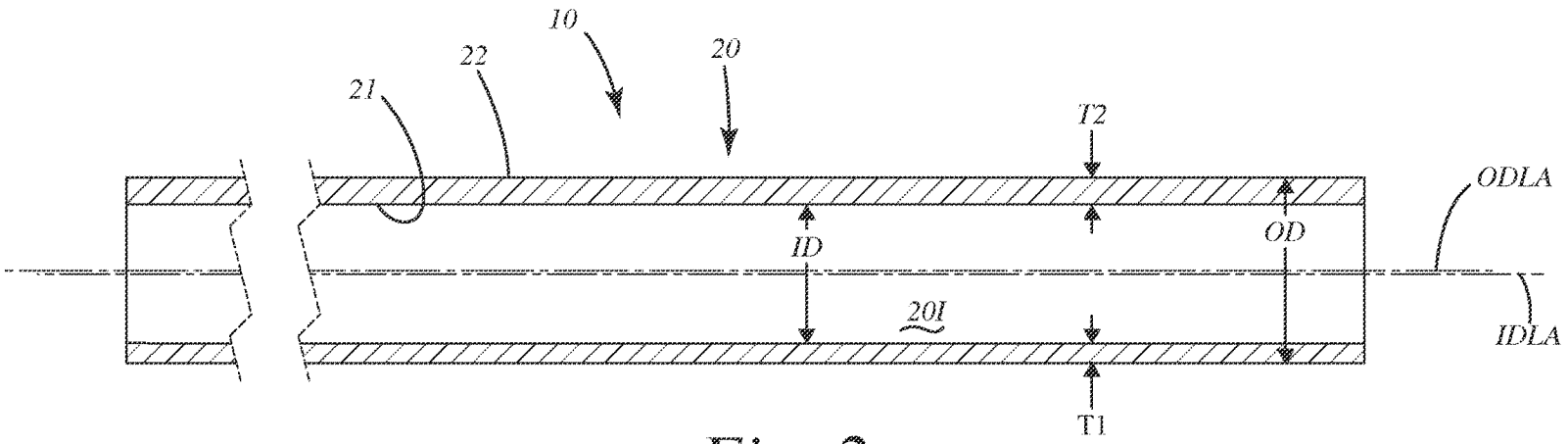
FIG. 2 is a sectional view taken along lines 2-2 of FIG. 1 showing a shaft of the arrow pre-assembly with an exterior surface of a shaft non-concentric with an interior surface of the shaft.
Figure 3:
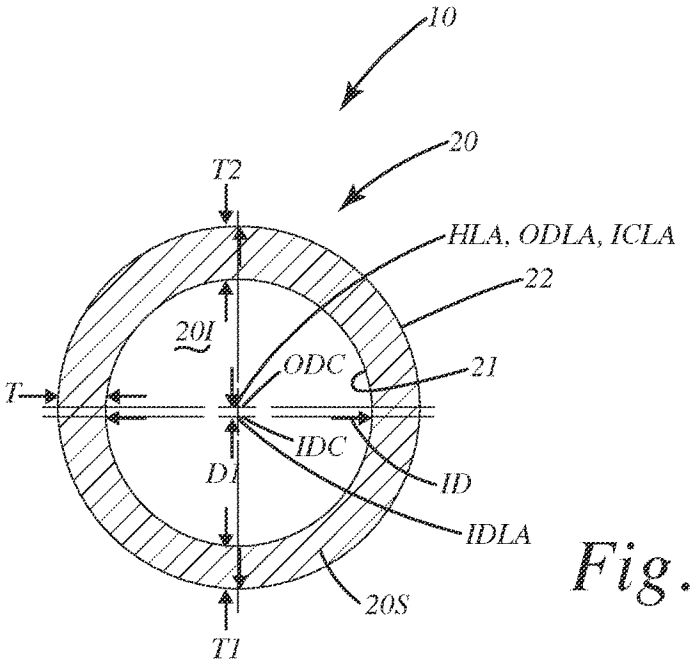
FIG. 3 is a sectional view of the shaft taken along lines 3-3 of FIG. 1 pre-assembly.

As shown in FIGS. 2 and 3, the outer surface 22 of the shaft 20 can be centered on an outer diameter longitudinal axis ODLA. As shown there, the insert 40 is removed from the shaft 20. The outer diameter longitudinal axis ODLA can be in the geometric center of the exterior surface 22 of the shaft 20. As mentioned above, the exterior surface can be a cylindrical surface. Thus, when taken in cross section, for example shown in FIG. 3, the outer diameter longitudinal axis ODLA can be and can extend through a first center, also referred to as an outer diameter center ODC. This first center ODC can be perfectly centered in a circle that comprises the exterior surface 22. Optionally, the exterior surface 22 can be centerless ground before the assembly of the insert relative to the shaft. When centerless ground, the exterior surface is ground or machined to produce a cylindrical outer surface without relation to the precise center of the shaft, and without relation to the inner surface or interior surface center IDC of the shaft. This produces a naturally non-concentric condition because the center of the outer surface is not the same as the center of the inner surface.

As shown in FIGS. 2 and 3, the exterior surface 22 of the shaft 20 of the arrow is illustrated generally as a circle having a circumference. The circumference corresponds to the outer surface or exterior surface 22 of the cylinder that forms the shaft 20. The outer surface 22 also can be correlated to an outer diameter OD. This outer diameter can correspond to a diameter of the circular or cylindrical outer surface 22 of the shaft 20. This outer diameter OD can be relatively constant throughout all degrees of the rotation of the outer diameter OD about the center ODC of the outer surface 22. Of course, in some applications, there may be some surface aberrations, contours, undulations or other defects in the exterior surface 22 which may cause the outer diameter OD to vary slightly.

The exterior surface also can include a corresponding outer diameter center ODC which can be halfway between the ends of the outer diameter OD. This outer diameter center, or first center ODS can lay along the outer diameter longitudinal axis ODLA and can form the centerline of the outer surface 22 of the shaft 20. This outer diameter longitudinal axis ODLA can extend lengthwise along the entire length of the shaft 20 and the arrow. With reference to FIGS. 2 and 3, as mentioned above, the shaft can include the exterior surface 22 as well as the interior surface 21. This interior surface likewise can be a cylindrical surface running along the interior 201 of the tubular shaft 20. The interior surface 21 can be centered on a center line which corresponds to an inner diameter longitudinal axis IDLA. The interior surface 21 can be a cylindrical interior surface and thus when taken in cross section, for example, as shown in FIG. 3, the inner diameter longitudinal axis IDLA can extend through a second center or inner diameter center IDC. This inner diameter center IDC can be perfectly centered in the circle formed by the interior surface 21 when that surface and the shaft are taken in cross section. Optionally, the interior surface is unaffected by the centerless grinding of the exterior surface as mentioned above.

The interior surface 22 also can be correlated to an inner diameter ID. This inner diameter ID can correspond to a diameter of the circular or cylindrical inner surface 21 of the shaft 20. This inner diameter ID can be relatively constant throughout all degrees of rotation about the inner diameter center IDC. Of course, in some applications, there may be some surface aberrations, contours, undulations or other defects in the interior surface which may cause the inner diameter ID to vary slightly. The inner diameter center IDC can be disposed at a location halfway between the ends of the inner diameter ID and can lay along the inner diameter longitudinal axis IDLA, forming the center line of the inner surface. This inner diameter longitudinal axis IDLA can extend lengthwise along the entire length of the shaft and the arrow. Further, the inner diameter ID can be offset, along with the inner diameter center and inner diameter longitudinal axis in a variety of different directions and orientations relative to the outer diameter center and outer diameter longitudinal axis, rather than disposed under one another as shown in FIG. 3.

As shown in FIGS. 2 and 3, the outer diameter longitudinal axis can be offset a first distance D1 from the inner diameter longitudinal axis IDLA. Likewise, the inner diameter center IDC can be offset from the outer diameter center ODC by the first distance D1. Further, the outer diameter OD can be greater than the inner diameter ID as shown in FIG. 3. The outer diameter longitudinal axis, sometimes referred to as the outer diameter center line can be offset from the inner diameter longitudinal axis, sometimes referred to as the inner diameter centerline, optionally at least 0.0001 inches, at least 0.001 inches, 0.005 inches, 0.010 inches, 0.050 inches, or other distances. Generally, with this first distance D1 offsetting the inner diameter center line and the outer diameter center line, the interior surface 21 is non-concentric relative to the outer surface 22. Furthermore, due to the offsetting of the centers of the optional cylindrical surfaces 21 and 22, the interior and the exterior likewise can be considered to be non-concentric. This is better illustrated in FIG. 3, where the exterior surface 22 and the interior surface 21 clearly do not have the same center, that is the inner diameter center IDC and the outer diameter center ODC are not in the same location, are distal from one another, and/or are offset by the distance D1, along with the respective axes that pass through these centers. Optionally, the overall wall thickness T can vary from a first thickness T1 to a second thickness T2 due to the non-concentricity of the inner and outer surfaces or the offsetting of the centers of those surfaces. For example, the first thickness T1 of the shaft side wall 20S can be less than the second thickness T2 of the shaft side wall directly opposite the thickness T1. Optionally, the first thickness T1 can be 0.029 inches and the second thickness T2 can be .039 inches. Again, these are exemplary thicknesses and can vary depending on the application. Between the thicknesses T1 and T2 of the shaft side wall, the thickness T can vary. With varying thicknesses, the weight distribution of the shaft sidewall about the outer diameter center ODC or the outer diameter longitudinal axis ODLA can vary. In some cases, this can produce inconsistent and/or unstable rotation of the shaft generally about the outer diameter center or axis.

Optionally, the shaft as described herein can be constructed from multiple layers of carbon, composite, fabric, sheets, resin, adhesives and other materials. Of course, other types of composite materials can be used and, in some cases, the shaft can be constructed from a polymeric tube.

As noted above and shown in FIGS. 2 and 3, the non-concentric interior surface and exterior surface, which results in the inner diameter center IDC and outer diameter center ODC being offset by a distance D1 along with the respective outer diameter longitudinal axis and inner diameter longitudinal axis, can create balance issues, particularly when an insert is installed relative to the shaft and subsequently a component, such as a broadhead 80, is installed relative to the insert 40. With reference to FIG. 7, a proposed solution to address this offset is an insert 40 that is joined with the shaft using a manufacturing method as described below. The result of that method, shown in FIG. 7 is the insert 40 being joined with the shaft 20. As shown there, the insert 40 can include define a hole 50 that extends longitudinally through the insert 40. The insert 40 can include a base 41 and a collar 42. The base 41 can be the portion that is installed within the shaft 20. The collar 42 can be a portion of the insert that extends a distance D2 outside the shaft, forward of the first end 11 and the circumferential edge 24 of the shaft. The insert 40 can be constructed from a metal, such as aluminum or alloys, polymers, composites or other materials depending on the application.

Optionally, the hole 50 can comprise a first portion 51 which can be optionally threaded, and a second portion 52 which can be unthreaded. The hole can be round and/or can include round and/or cylindrical portions which are the first portion 51 and the second portion 52. Each of these portions 51 and 52 can comprise the hole 50. The hole 50 also can define a hole longitudinal axis HLA. This hole longitudinal axis can be common with, lay along, be parallel to and/or be the same axis as the outer diameter longitudinal axis ODLA and can pass through the outer diameter center ODC. This hole longitudinal axis HLA however can be offset the first distance D1 from the inner diameter longitudinal axis IDLA, the insert axis ILA, the inner diameter center IDC that correspond to the interior surface 21 of the shaft 20. Optionally, the first portion 51 and second portion 52 of the hole 50 likewise both can be centered on the hole longitudinal axis HLA.

As further shown in FIG. 7, the first portion 51 of the hole 50 can be disposed generally inboard relative to the forward most or outer edge 24 of the shaft 20. The second portion 52 of the hole 15 can be disposed forward of or beyond the edge 24 and generally not disposed within or overlap the inner surface 21 or outer surface 22 of the shaft 20. As mentioned above, the first portion 51 also can be threaded to receive the threads 81T of the broadhead 80 as shown in FIG. 8. In particular, the stem 81S of the broad head can be threaded with threads 81T which can interact with threads of the first portion 51 of the hole. The remaining portion 82 of the stem can be unthreaded and can fit within the second portion 42 of the collar of the insert. The broadhead main body 85 can extend forwardly of the forward edge 44 of the insert 40. This main body 85 optionally can include blades, a tip and/or a point depending on the construction of the broadhead 80.

The broadhead 80 or another component installed in the insert can include a central axis BCA. This central axis BCA can be a rotational and longitudinal axis of the broadhead. When the broadhead 80 is installed relative to the shaft 20 of the arrow 10, this central axis BCA can correspond to, lay along, be common with and/or otherwise parallel to the outer diameter longitudinal axis ODLA, the hole longitudinal axis HLA and in some cases noted in the embodiment below, the insert longitudinal axis ILA. This central longitudinal axis or center line axis BCA however, can be offset the distance D1 from the inner diameter longitudinal axis IDLA. Optionally, the respective first portion 81 and second portion 82 of the stem can be concentric with the exterior surface 22 of the shaft 20, but nonconcentric with the inner surface 21 of the shaft 20. Further, as explained above, the round hole 50 and its respective portions 51 and 52 can be concentric with the outer surface 22 of the shaft, but non-concentric with the inner surface of the shaft.

A method of manufacturing the arrow 20 of the current embodiment will now be described with reference to FIGS. 1-8 along with additional features and elements of the shaft, insert and broadhead. Generally, the method can include providing a shaft 20 that optionally is tubular and round, and includes an exterior surface 22 and an opposing first interior surface 21, the exterior surface 22 centered on an outer diameter longitudinal axis ODLA, the opposing first interior surface 21 centered on an inner diameter longitudinal axis IDLA; and securing the insert 40 to the shaft 20, wherein the insert 40 is centered relative to the exterior surface 22 of the shaft to balance the arrow 10.

The shaft 20 can include the exterior surface 22 and the opposing interior surface 21 on the inside or interior 211 of the shaft. Due to manufacturing constraints, the interior surface and exterior surface can be non-concentric. As a result, the respective inner diameter center IDC can be offset the distance relative to the outer diameter center ODC, for example, as shown in FIG. 3. Although shown as a single distance D1, these centers can be offset a variety of different distances along the length of the shaft where the tolerances for manufacturing the shaft are large. Likewise, the inner diameter longitudinal axis IDLA and the outer diameter longitudinal axis ODLA can be offset the distance D1 or varying distances. Further, the thickness T of the side wall 20 of the shaft can vary from a first distance T1 that is different, less than or greater than a second thickness T2.

Optionally, the shaft 20 can be constructed from various layers of resin, fabric, carbon fibers, glue, cement or other materials. The exterior surface 20 can be centerless ground on equipment, such as a lathe to smooth that outer surface and optionally make it generally cylindrical. Of course, this machining can be optional and may not be performed in some applications.

Figure 4:
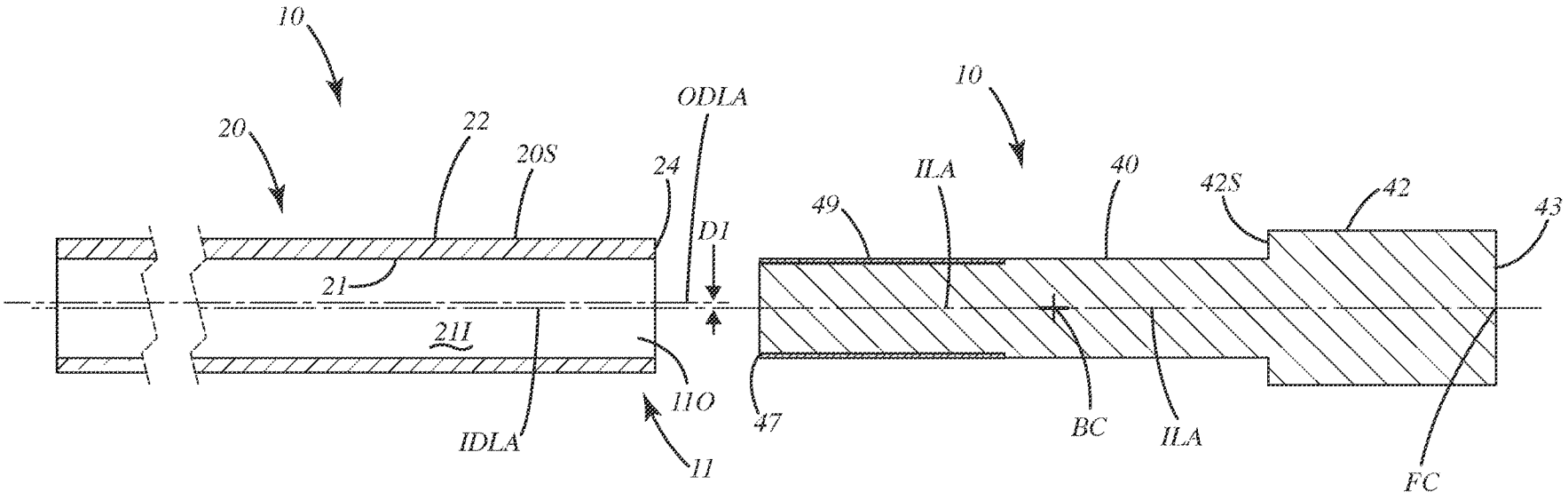
FIG. 4 is a sectional view of the partially machined insert being installed relative to the shaft.
Figure 5:
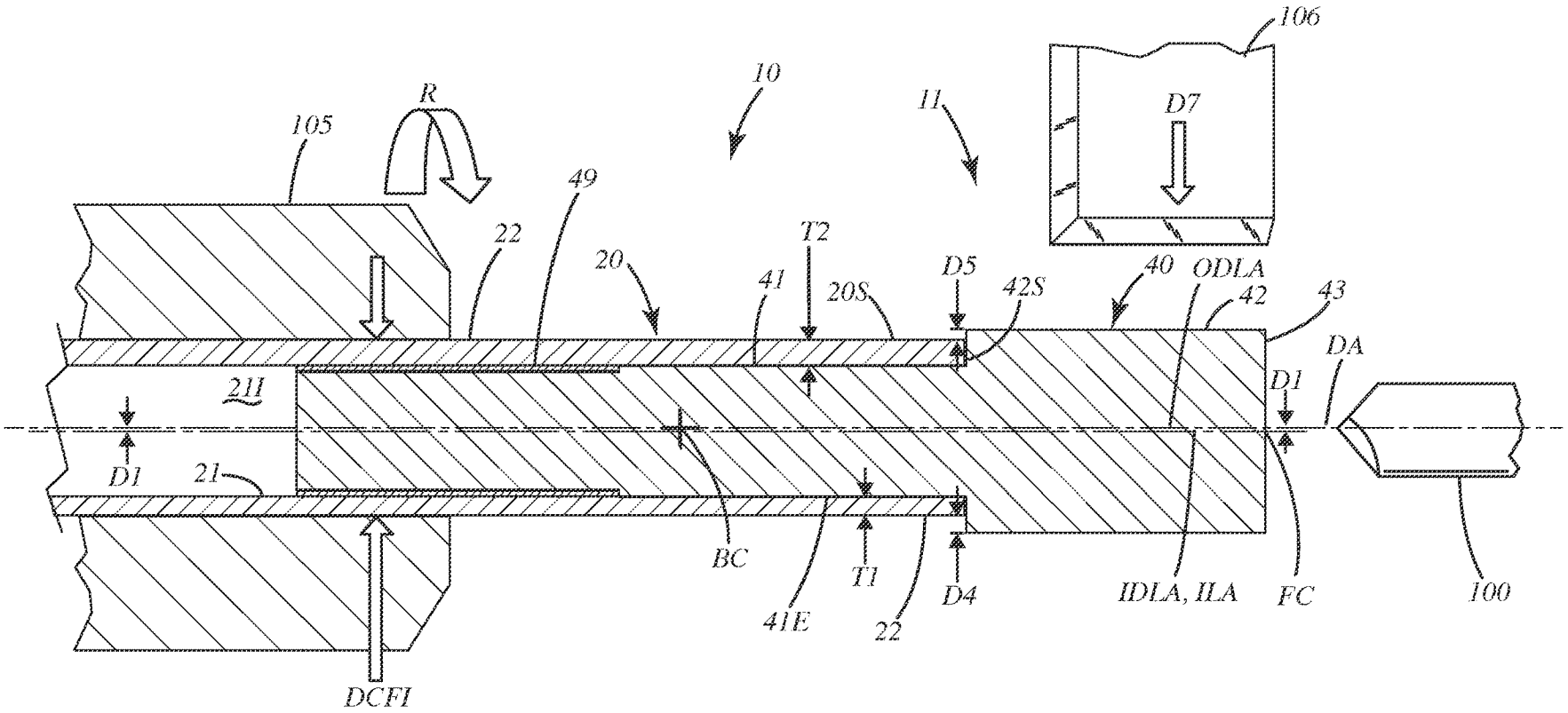
FIG. 5 is a sectional view of the partially machined insert installed relative to the shaft and adhered in a fixed position relative to the shaft.
Figure 6:
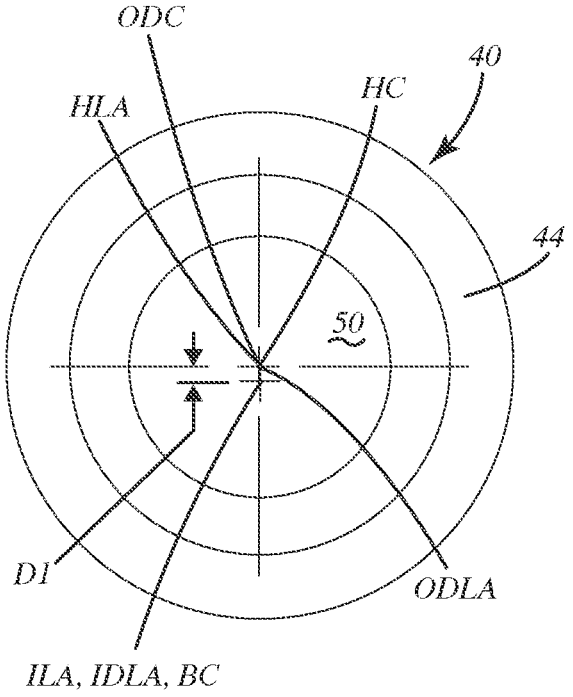
FIG. 6 is a is a sectional view of the fully machined insert installed relative to the shaft with a round hole concentrically formed relative to an exterior surface of the shaft.

The shaft 20 as shown in FIGS. 4 and 5 can be prepared for installation of insert 40. The insert 40 however is shown only partially machined. For example, the insert 40 can be machined such that it defines a base 41 and a collar 42, with no hole 50 formed yet therein. As mentioned above, the base 41 can be configured for installation within the interior 211 of the shaft 20 that is bounded by the sidewall 20S of the shaft and by the interior surface 21. The base 40 can be coated with and/or can include a adhesive 49. Optionally, the adhesive can be disposed on knurling, grooves, or other surface treatments of the base 41 to enhance adhesion and joining of the insert with the shaft. The tip 47 of the base 41 can be aligned with the first end 11 and the opening 110 of the shaft 20. Upon this alignment of the tip 47, the base 41 can further be inserted into the interior 201 of the shaft 20 until the shoulder 42S that separates the base 41 and the collar 42 engages the edge 24 of the shaft 20. Optionally, where the collar is not present, some other reference point along the insert can be used to determine the appropriate depth of insertion of the insert 40 into the interior 21I.

The base 41 and collar 42 can include an insert longitudinal axis ILA that extends longitudinally through the insert 40. The base 41 can include a base center BC which can be the geometric center of a cross section of the base taken anywhere along the length of the base and/or insert 40. The insert longitudinal axis ILA can be located and/or can extend through the base center BC. The base center also can lay along the insert longitudinal axis ILA.

As the base 41 is installed, the insert longitudinal axis ILA, which also extends through the face 34 of the insert 40 and through the center FC of the face, becomes aligned with and can become common with the inner diameter longitudinal axis IDLA. Upon full installation of the insert, for example is shown in FIG. 5, the insert longitudinal axis ILA is common with, lays along, and is coextensive with the inner diameter longitudinal axis IDLA. Again, due to this, the insert longitudinal axis ILA is offset or distal from the outer diameter longitudinal axis ODLA. Thus, the insert exterior surface 41E is nonconcentric with the outer diameter and the exterior surface 22 of the shaft 20. The exterior surface 41E of the insert however is concentric with the inner surface 21 of the shaft 20 which again can be a cylindrical or round surface similar to the cylindrical or round exterior 41E of the insert 40. The face 43 can include the face center which also can be offset the distance D1 from the outer diameter longitudinal axis ODLA as well as an outer diameter center ODC of the shaft that corresponds to the center of the exterior surface 22 of the shaft 20.

As can be seen in FIG. 5, after installation of the insert 40 within the interior 211 of the shaft 20, the collar 42 can remain extended beyond the forward edge 24 of the shaft 20. Due to the offset nature of the insert longitudinal axis ILA relative to the outer diameter longitudinal axis or the insert center relative to the outer diameter center, the shoulder 42S can overlap different portions of the shaft sidewall 20S different amounts. For example, where the side wall 20S includes the thickness T1, the shoulder 42S can overlap and extend beyond the exterior surface 22 a distance D4. Where the thickness of the sidewall 20S is a greater thickness T2, the shoulder can extend beyond the exterior surface 22 a distance D5. The distance D5 can be less than the distance D4. Generally, the shoulder can overlap the sidewall, extending beyond the exterior surface 22, varying degrees around the center or outer diameter longitudinal axis of the shaft 20.

These uneven amounts of overlap of the shaft 20 and/or the insert 40 can be addressed and corrected if desired. For example, the adhesive 49 can be allowed to cure to firmly secure the insert 40 to the shaft 20 in a non-movable, fixed orientation so that the elements do not rotate relative to one another. After this curing, the arrow 20 can be installed relative to a holder 105, which can be a collet, clamp, or other holding device, as shown in FIG. 5. This holder 105 can exert a clamping force CF1 on the shaft 20 and/or optionally the insert 40 although not shown. The holder, which optionally can be a portion of a lathe, can rotate the shaft and insert in direction R in unison. A trimmer 106 can be moved toward the collar 40 in direction D7 as the holder 105 rotates the insert 40 and shaft about the outer diameter longitudinal axis ODLA, rather than the inner diameter longitudinal axis IDLA or insert axis ILA. The center of rotation optionally is the outer diameter longitudinal axis. As this occurs, the trimmer 106 can be engaged against the collar 40. As it does so, it removes material from the exterior surface of the collar so that the exterior surface of the collar becomes flush with the exterior surface 22 of the shaft 20. After this trimming is completed, there is no overlap D4 or D5 at the edge 24 by the collar 42. Of course, in some applications, this trimming operation can be absent from the method.

FIG. 5 also illustrates the arrow 10 before the insert 40 is further machined to form a hole 50 therein. The holder 105 can hold the arrow and/or the insert and spin these items in direction R. A cutter, such as a drill 100 is moved toward the face 43. The cutter or drill point can include a drilling axis DA. The drilling access DA can be aligned with, common with and parallel to the outer diameter longitudinal axis ODLA, but offset the distance D1 from the inner diameter longitudinal axis IDLA, the face center FC and the insert longitudinal axis ILA. As the cutter 100 penetrates the face 43, it also is offset from the face center FC and the base center BC of the insert. As the cutter continues to penetrate the insert 40, it produces the hole 50 including the different portions 51 and 52 described above. After the hole is formed, the cutter 100 can be removed from the insert.

The hole can include a hole longitudinal axis HLA that extends through the hole and through a hole center HC. This hole longitudinal axis and the hole center can lay along and/or be common with the outer diameter longitudinal axis extending longitudinally through the shaft 20. Optionally, the hole center HC and the first center ODC lay along the outer diameter longitudinal axis ODLA or a common axis extending longitudinally through the shaft. The hole longitudinal axis HLA also can be offset from the insert longitudinal axis ILA of the insert 20. The exterior surface 40E of the insert can be non-concentric with the hole which again can be a round and/or cylindrical hole.

Optionally, as shown in FIG. 7, the insert sidewall 40W that is included in the base 41 can have varying thicknesses. This can be due to the offset nature of the hole 50 in particular the hole portion 51 within the base 41. For example, the thickness T3 of the insert side wall 40W can be less than the thickness T4 of the side wall opposite that thickness T3 due to this nonconcentric relationship between the hole 50 and the exterior 40E of the insert 40. Of course, these thicknesses can be reversed and T3 can be greater than T4. Moreover, these thicknesses can be disposed in different regions of the sidewall 40W around the hole longitudinal axis HLA.

Figure 9:
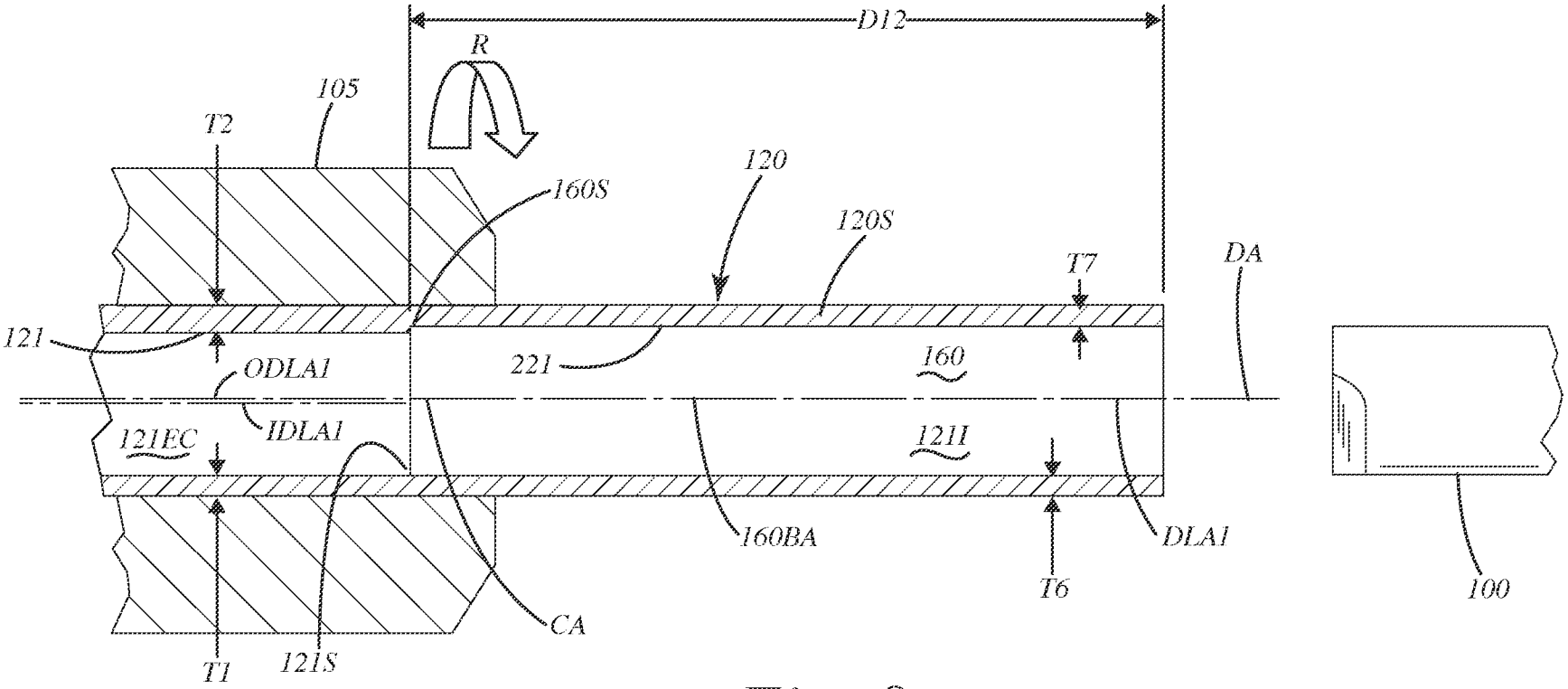
FIG. 9 is a side view of an alternative embodiment of an arrow, including a machined interior surface of a shaft forming a bore to establish concentricity between an exterior surface of the shaft and the bore, as well as an insert later installed in the bore.
Figure 10:
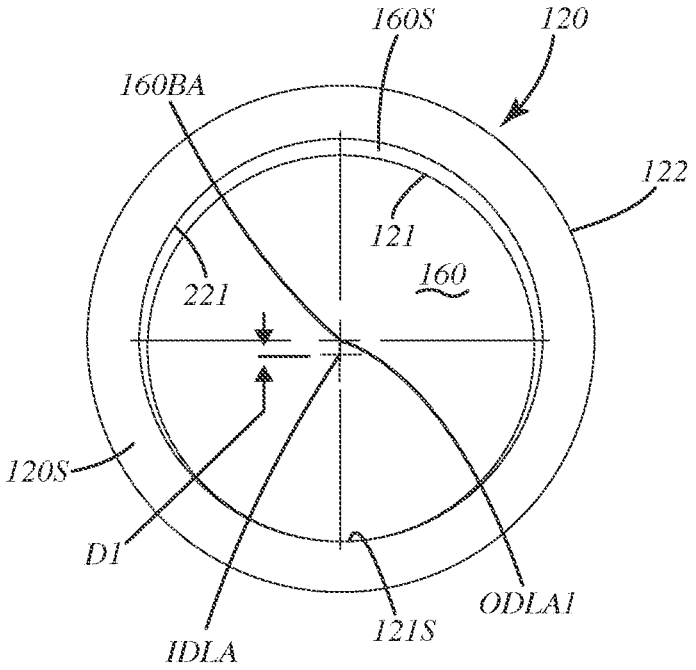
FIG. 10 is a sectional view of the shaft showing the newly machined bore and its center aligned with a center of the exterior surface of the shaft.
Figure 11:
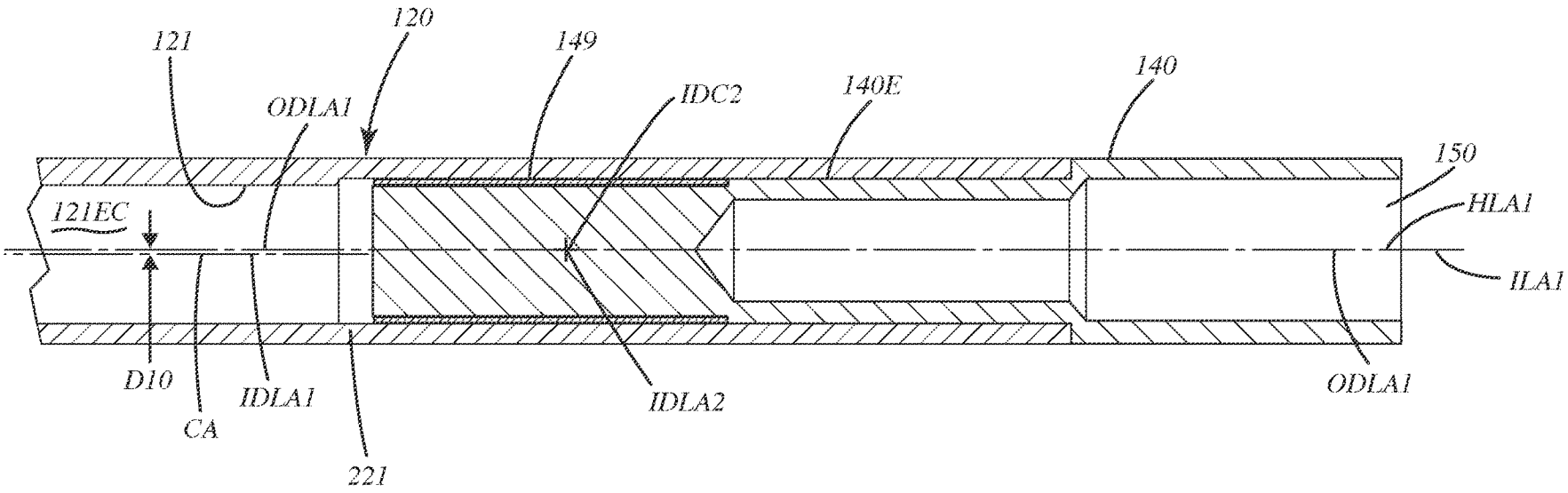
FIG. 11 is a sectional view of the fully machined insert installed relative to the shaft.

An alternative embodiment of the arrow is shown in FIGS. 9-11 and generally designated 110. This arrow 110 can be similar in structure, operation and function to the embodiment above with several exceptions. For example, the arrow 110 can include a shaft 120 having an interior surface 121 and an exterior surface 122. An insert 140 can be installed relative to the shaft 120. This insert, however, can be pre-machined and can include a pre-machined hole 150. This pre-machined hole 150 can include a hole longitudinal axis HLA1 that is common with an insert longitudinal axis ILA1. This hole longitudinal axis HLA1 and insert longitudinal axis ILA1 can be disposed on, common with and the same as the outer diameter longitudinal axis ODLA1 when the insert is installed in the shaft. Thus, the hole 150 and its portions can be concentric with the exterior surface 122 which again can be a cylindrical surface of the shaft 120. The hole longitudinal axis HLA1 and the insert longitudinal axis ILA1 however can be offset a distance D10 from the inner diameter longitudinal axis IDLA1 which can be the arrow internal diameter center line corresponding to and extending through the geometric center of the interior surface 121 of the arrow.

In this construction however, the interior surface 121 of the shaft can be structured and machined to include a newly formed, second interior surface 221 that is centered on the outer diameter longitudinal axis OLDA1 in the shaft 120 before the insert 140 is installed. This second interior surface 221 can be concentric with the exterior insert surface 140E and/or concentric with the exterior surface 122 of the shaft. This second interior surface 221 also can include a second internal diameter longitudinal axis IDLA2 along which the second center line or center IDC2 of the second interior surface 221 is formed. The new or second interior surface 221 also can be generally cylindrical in shape and can have a circular cross section as with the embodiments above.

As shown and FIG. 9, the second interior surface 221 can be formed by optionally holding the shaft 120 with a holder 105 and rotating the holder in direction R. As this occurs, a cutter 100 can be directed along a cutting axis DA which is common with, and extends along, the outer diameter longitudinal axis ODLA1 instead of the inner diameter longitudinal axis IDLA1 of the first or original interior surface 121. The cutter can be advanced into the interior 1211 of the shaft a distance D12. As it does so it removes shaft material from the shaft sidewall 120S and forms a cylindrical bore 160 within the shaft 120. As the material is removed the thickness of the sidewall of the shaft at the end of the shaft can change so that the thickness of the sidewall 120S is modified near the end from varying or unequal thicknesses T1 and T2 to thicknesses T6 and T7 which can be equal.

The cylindrical bore 160 formed can include a bore axis 160BA that is coextensive with and common with the outer diameter longitudinal axis ODLA1. Where the cutter stops 100 after extending the distance D12 into the shaft 120, a shoulder 160S can be formed. This shoulder is disposed between the cylindrical bore 160 and an elongated cavity 121EC that is defined by the original interior surface 121 of the shaft 120. Of course, in some locations the shoulder can taper down to be nonexistent where the bore 160 shares a common surface with the original interior surface 121, for example, as shown at the location 121S.

Optionally, the elongated cavity 121EC can include a cavity axis CA that is common with and lays along the inner diameter longitudinal axis IDLA1 but is offset from the bore axis 160BA and the outer diameter longitudinal axis ODLA1. This elongated cavity axis formed by the original interior surface 121 can be nonconcentric with the round hole 150 of the insert and nonconcentric with the bore 160. After the bore 160 is formed, the previously machined insert 140 can be installed in the bore 160 and adhered therein with an adhesive 149. Of course, a component such as a broadhead 80 can be installed in the insert similar to the embodiment above and can be aligned so its broadhead axis is aligned with the hole axis HLA1, the bore axis 160BA and the outer diameter longitudinal axis ODLA 1.

The embodiments of the arrows herein can change the way arrows are sold and distributed to archery dealers, users and consumers. For example, in the current embodiments, the arrows 10 and 110 can be manufactured and assembled with the inserts 40 and 140 fully installed and secured to the respective shafts 20 and 120 to set and preserve the concentricity of the insert hole, and thus the broadhead, and the exterior surface or outer diameter of the shaft. These arrows, with the inserts already installed by the manufacturer can then be distributed to dealers and end users. This is different from current practice, where the dealers or end users typically install the inserts after cutting the arrow and in particular the shaft to a custom length for a user.

Accordingly, with the inserts already installed at the first end of an arrow shaft and effectively balanced or centered on the outer diameter longitudinal axis as provided in the current embodiments, the dealer or end user can cut the arrow shaft at the opposing second end to custom fit the length of the arrow to a user, rather than at the first end including the already installed insert. After this cutting to a custom length, the dealer or a user can install the fletchings and a nock in the second end of the arrow, opposite the insert.

The following additional statements are provided, the numbering of which is not to be construed as designating levels of importance.

Statement A. A method of offering an arrow, the method comprising: providing an arrow comprising a shaft having an exterior surface centered on an outer diameter longitudinal axis or first geometric center and an interior surface centered on an inner diameter longitudinal axis, and an insert defining an insert hole having a hole axis common with the outer diameter longitudinal axis, but optionally offset a distance from the inner diameter longitudinal axis, the insert fixedly secured to a first end of the shaft and non-removable from the shaft; shipping the arrow to an end user or dealer; and instructing the end user or dealer to cut the shaft at a second end, distal from the insert and the first end, to achieve a custom length of the arrow, without removing the insert from the first end.

Statement B. The method of Statement A, comprising providing a plurality of fletchings with the arrow, and instructing the end user or dealer to install the plurality of fletchings a preselected distance from the second end of the shaft after the arrow is cut.

Statement C. The method of any preceding Statement, comprising; providing a nock with the arrow, and instructing the end user or dealer to install the nock in the second end after the arrow is cut.

Statement D. The method of any preceding Statement, comprising forming a hole in the insert along a hole axis that is common with the outer diameter longitudinal axis after adhering the insert to the shaft, by rotating the shaft and the insert together in unison.

Statement E. The method of any preceding Statement, comprising boring a hole in the first end of the shaft along a bore axis that is common with and lays along the outer diameter longitudinal axis before installing the insert in the first end, and installing the insert in the first end.

Statement E. The method of any preceding Statement, comprising taking an arrow provided with the insert fixedly joined with a first end, the arrow including the insert hole axis common with the outer diameter longitudinal axis, and cutting a second end distal from the first end to a predetermined length corresponding to a user's draw length, without cutting the first end including the insert.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element, or assembly of one or more elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Furthermore, the particular features, structures, or characteristics may be combined in any suitable manner in one or more embodiments.

What is claimed is:

1. A method of manufacturing an archery arrow, the method comprising:

providing a shaft having a length corresponding to an archery arrow, the shaft including a first end and a second end, the shaft including an exterior surface that is cylindrical and an interior surface that is cylindrical, the exterior surface having an outer diameter and a first center, the interior surface having an inner diameter and a second center;

installing an insert in the shaft adjacent the interior surface, the insert including a face disposed adjacent the first end;

securing the insert to the shaft; and forming a hole in the insert through the face after said securing the insert to form a hole diameter and a hole center, wherein the first center and the second center are offset from one another by a distance of at least 0.001 inches;

wherein the hole center and the first center lay along a common axis extending longitudinally through the shaft; and wherein the second center is offset from the common axis.

2. The method of claim 1 comprising:

allowing an adhesive to cure so that the insert is secured to the interior surface of the shaft; and engaging the exterior surface of the shaft with a machine to hold the shaft as the hole is formed in the insert and while the insert and shaft rotate in unison about the common axis.

3. The method of claim 1, comprising:

providing the insert with a base and a collar, the collar including the face, the base including a base center; and providing the insert with an insert longitudinal axis that is located at the base center and extends through the base center;

wherein said forming the hole includes drilling the hole through the face and into the base along a hole longitudinal axis that is offset from the insert longitudinal axis and the base center.

4. The method of claim 3, wherein the hole longitudinal axis is parallel to the insert longitudinal axis.

5. The method of claim 1, wherein the first center lays along an outer diameter longitudinal axis, wherein the second center lays along an inner diameter longitudinal axis, wherein the hole center lays along the outer diameter longitudinal axis.

6. The method of claim 5, wherein the face includes a face center that is offset and distal from the outer diameter longitudinal axis before said forming step.

7. The method of claim 1, comprising:

clamping the outer diameter of the shaft before said forming; and drilling with a drill the hole through the face and into a base of the insert along a hole axis that is offset from the second center and an inner diameter axis along which the second center is disposed.

8. The method of claim 7, wherein the base of the insert is inserted in the first end, wherein the base of the insert is adhered with an adhesive to the interior surface, wherein the base includes a base center that is offset a distance from the first center.

9. The method of claim 1, wherein the hole includes threads that wrap around a hole axis that passes through the hole center, wherein the hole axis is offset from a second diameter longitudinal axis along which the second center lays.

10. A method of manufacturing an arrow, the method comprising:

providing a shaft that is tubular and round, and includes an exterior surface and an opposing first interior surface, the exterior surface centered on an outer diameter longitudinal axis, the opposing first interior surface centered on an inner diameter longitudinal axis, wherein the outer diameter longitudinal axis and the inner diameter longitudinal axis are offset from one another by a distance of at least 0.001 inches; and securing an insert to the shaft, the insert including an exterior insert surface that is round, wherein the insert is centered relative to the exterior surface of the shaft to balance the arrow.

11. The method of claim 10, comprising:

defining in the insert an insert center and an insert longitudinal axis passing through the insert center, wherein the insert longitudinal axis is offset a first distance from the inner diameter longitudinal axis.

12. The method of claim 10, wherein the insert defines a hole having a hole longitudinal axis corresponding to a hole center, wherein the hole longitudinal axis is common with and lays along the outer diameter longitudinal axis, wherein the hole longitudinal axis is offset a first distance from the inner diameter longitudinal axis.

13. The method of claim 10, comprising:

installing the insert in the shaft adjacent the first interior surface, the insert including a face extending outside the shaft;

adhering the insert to the shaft with an adhesive during said securing; and forming a hole in the insert after said adhesive cures.

14. The method of claim 13, wherein the hole has a hole longitudinal axis, wherein the hole longitudinal axis is common with and lays along the outer diameter longitudinal axis, wherein the hole longitudinal axis is offset a first distance from the inner diameter longitudinal axis.

15. The method of claim 10, comprising:

forming a second interior surface centered on the outer diameter longitudinal axis in the shaft before said securing step, wherein the second interior surface is concentric with the exterior insert surface, which is concentric with the exterior surface of the shaft, wherein said forming the second interior surface comprises removing a shaft material from the first interior surface.

16. A method of manufacturing an arrow, the method comprising:

providing an arrow shaft that is tubular and round, and includes an exterior surface and an opposing first interior surface forming a bore, the exterior surface having an outer diameter and a first center, the first interior surface having an inner diameter and a second center, wherein the first center and the second center are offset from one another by a distance of at least 0.001 inches;

installing an insert in the bore, the insert including an exterior insert surface that is round and an insert face;

securing the insert fixedly to the arrow shaft; and drilling a hole in the insert through the insert face after the insert is secured fixedly to the arrow shaft along a hole longitudinal axis.

17. The method of claim 16, wherein the drilling the hole includes penetrating the insert face with a drill and moving the drill within the bore of the arrow shaft.

18. The method of claim 17, wherein the drill moves relative to the first interior surface as the drill moves within the bore.

19. The method of claim 17 comprising:

holding the arrow shaft and the insert stationary while advancing the drill into the insert to form the hole.

* * * * *